US005186216A

United States Patent [19]

Bollier

[11] Patent Number: 5,186,216

[45] Date of Patent: Feb. 16, 1993

[54] TORSION ROD TYPE PICKING MECHANISM FOR A PROJECTILE LOOM

[75] Inventor: Mauritius Bollier, Winterthur, Switzerland

[73] Assignee: Sulzer Brothers Limited, Winterthur, Switzerland

[21] Appl. No.: 770,644

[22] Filed: Oct. 3, 1991

[30] Foreign Application Priority Data

Nov. 2, 1990 [CH] Switzerland ..... 03479/90

[51] Int. Cl.[5] ..... D03D 47/24; D03D 49/26

[52] U.S. Cl. ..... 139/145; 267/277

[58] Field of Search ..... 139/142, 145, 157; 267/277, 278

[56] References Cited

U.S. PATENT DOCUMENTS 2,715,422 8/1955 Pfarrwaller ..... 139/145
3,476,375 11/1969 Brasseur ..... 267/277
4,458,726 7/1984 Wenig ..... 139/11

FOREIGN PATENT DOCUMENTS 1089664 10/1953 France .
1089665 10/1953 France .
2067606 1/1981 United Kingdom .

*Primary Examiner*—Andrew M. Falik
*Attorney, Agent, or Firm*—Kenyon & Kenyon

[57] ABSTRACT

The picking mechanism has a torsion rod whose zero position is adjustable by an adjusting lever and an adjusting drive. A rigid wedge-shaped intermediate member movable by the adjusting drive is disposed between a sliding surface of the adjusting lever and a stationary sliding surface. Movement of the intermediate member produces a pivoting movement of the adjusting lever to alter the zero position. The intermediate member transfers a force exerted by the adjusting lever on to the stationary sliding surface.

14 Claims, 2 Drawing Sheets

100
99
104
103
98
102
101
106
150
151
105
107
108
109
110
111
11
10
4
3
2
1
120
15a
15b
12a
111a
111b
12
17
121
121a
10a
10b
18

TORSION ROD TYPE PICKING MECHANISM FOR A PROJECTILE LOOM

This invention relates a picking mechanism for a projectile loom.

As is known, various types of projectile looms have been provided with a picking mechanism in which an adjusting lever is secured to a torsion rod in order to bring about the picking of a projectile across the loom, for example, into a catching device.

As described in Swiss Patent 641,506, in order to compensate for variations in operation, the variable zero position of the torsion rod is adjusted by means of an adjusting drive and a control mechanism to ensure a constant picking rate. Variations in operations occur, for example, because of interruptions in the operation of the loom. A particularly noticeable feature is that after a prolonged stoppage during which the loom cools and a film of lubricant in the bearings and mountings is interrupted, picking becomes much slower, assuming that the zero position of the torsion rod remains unaltered. If the projectiles are not to enter the catching device too late after a cold start, the zero position must be so adjusted that the torsion rod is stressed more than would be necessary for normal operation.

In the absence of means for adjusting the zero position, the flight of the projectile is faster in normal operation than is necessary, resulting in unnecessary energy expenditure and in increased wear of the projectile, guide teeth, catching brake and picking mechanism.

The known torsion rod control enables the projectile loom to be operated with improved energy consumption and less wear. However, the device described in Swiss Patent 641,506 has a serious disadvantage, for the adjusting drive so acts on the torsion rod adjusting lever that when the projectile is shot, the picking mechanism reacts by a detrimental abrupt stressing of the adjusting drive.

Accordingly, it is an object to the invention to obviate or, at least, attenuate the abrupt stressing of an adjusting drive for a torsion rod in a picking mechanism for a projectile loom.

It is another object of the invention to provide a simplified adjusting mechanism for a picking mechanism.

It is another object of the invention to relieve the drive of an adjusting mechanism for a torsion rod in a projectile loom of abrupt stressing during operations.

Briefly, the invention provides a picking mechanism for a projectile loom which is comprised of a torsion rod having a longitudinal axis, an adjusting lever secured to the rod for rotating the rod about the longitudinal axis relative to a zero position of the rod, and an adjusting mechanism pivoting the lever about its axis in order to vary the zero position of the rod.

In accordance with the invention, the adjusting mechanism includes a rigid intermediate member disposed between the adjusting lever and a stationary surface as well as a drive for moving the rigid member relative to the lever in order to effect a corresponding pivotal movement of the adjusting lever while transferring a force from the lever onto the stationary surface.

In one embodiment, the intermediate member is wedge-shaped and a drive is connected to the member in order to move the member in translation. In this embodiment, as the intermediate member is moved by the drive, the mutual sliding surfaces between the adjusting lever and intermediate member cause the adjusting lever to pivot and, thus, to vary the zero position of the torsion rod.

In another embodiment, the intermediate member is rotatably mounted on a second axis perpendicular to the lever and is provided with a screw thread. In addition, the drive for the intermediate member includes a stationary screw threaded surface receiving the screw thread of the intermediate member in order to effect movement of the intermediate member along the second axis in response to rotation of the member.

In still another embodiment, the intermediate member is rotatably mounted on a second axis parallel to the longitudinal axis of torsion rod and has a curvilinear surface of noncircular shape, e.g. a spiral surface, which contacts the adjusting lever for pivoting of the lever in response to rotation of the intermediate member.

These and other objects and advantages of the invention will become more apparent from the following detailed description taken in conjunction with the accompanying drawings wherein:

FIG. 1 illustrates a perspective view of a picking mechanism constructed in accordance with the invention;

FIG. 1*a* illustrates a variant of the wedge-shaped intermediate member;

Figure 3:
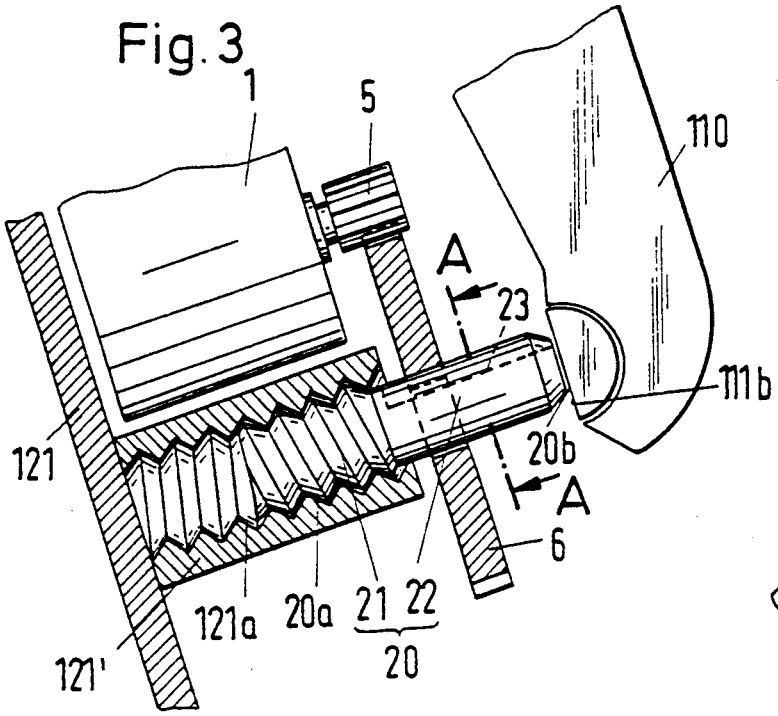
FIG. 3 illustrates a part cross sectional view of a modified adjusting mechanism in accordance with the invention.
Figure 3A:
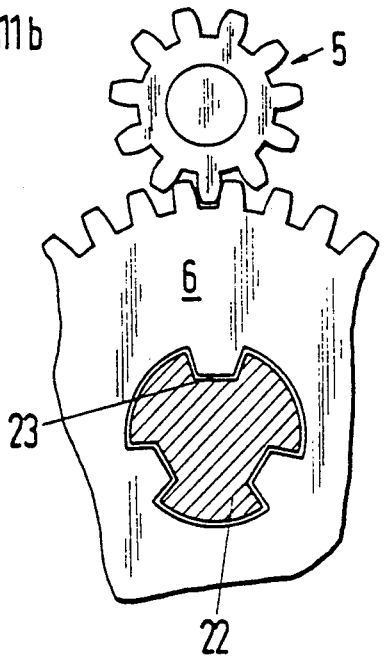

FIG. 3*a* illustrates a view taken on line A—A of FIG. 3; and

Figure 4:
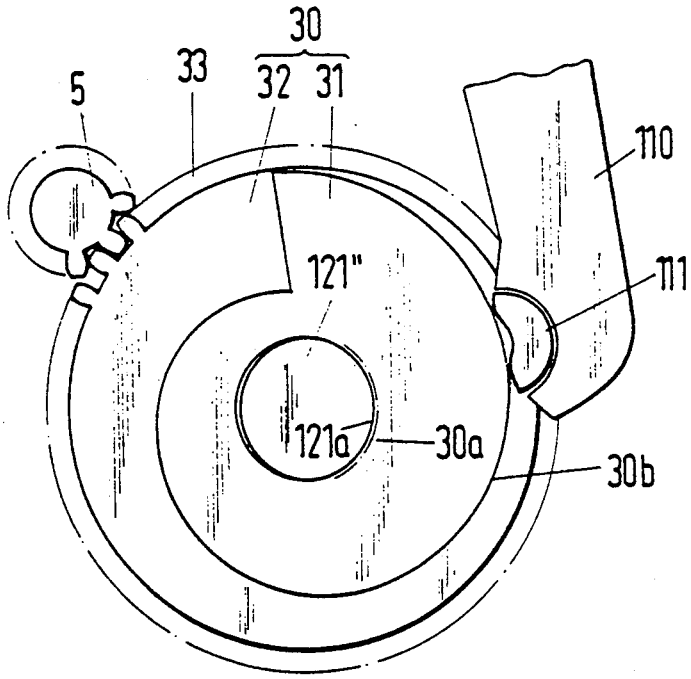

FIG. 4 illustrates a side view of a further embodiment employing a spiral surface for contacting an adjusting lever in accordance with the invention.

Figures 1, 1A, 2:
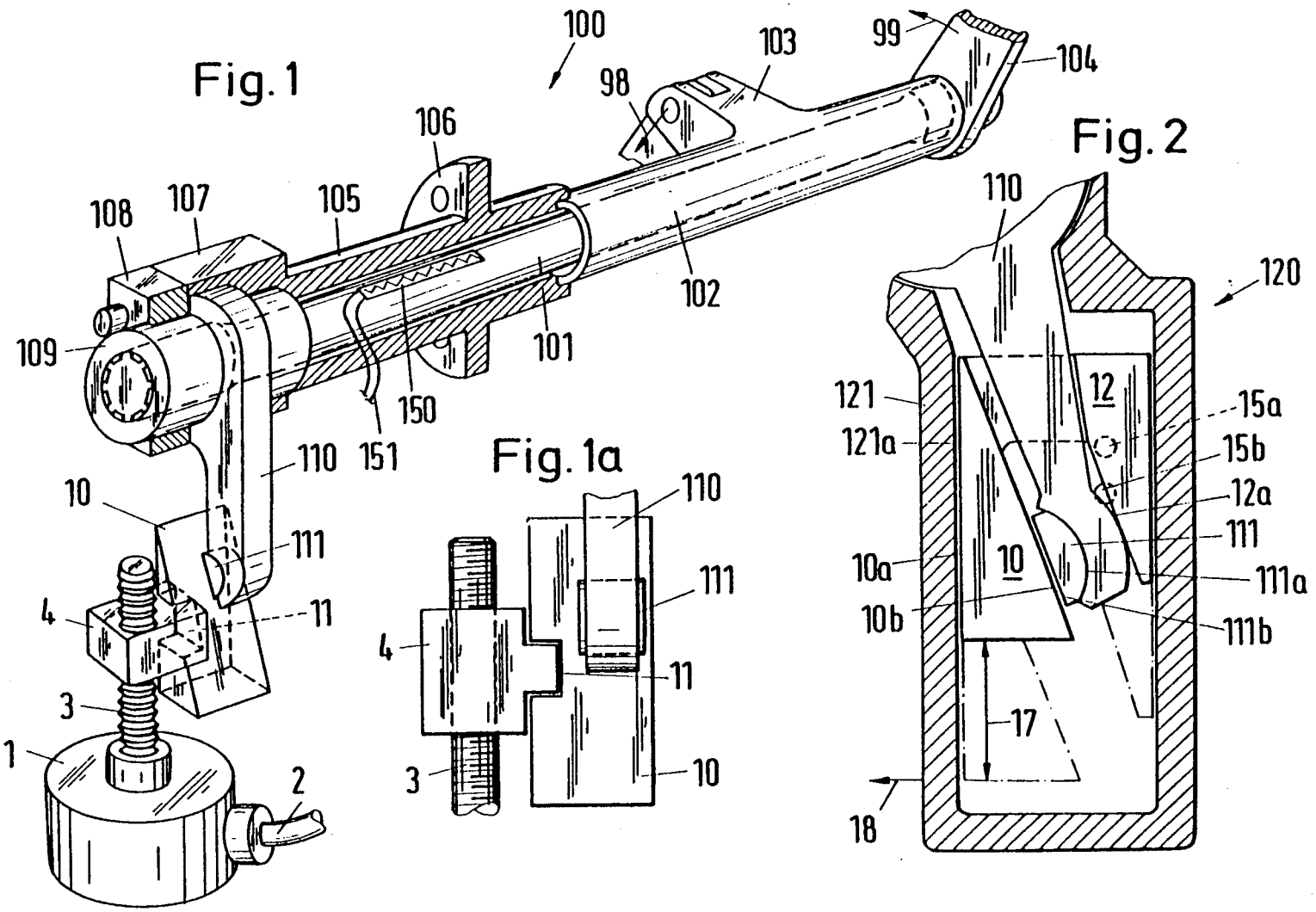
FIG. 2 illustrates a part cross-sectional view of a casing for housing the adjusting lever and intermediate member in accordance with the invention.

Referring to FIG. 1, the picking mechanism 100 for a projectile loom includes a torsion rod 101, a striker shaft 102 with a lever 103 for a cam follower lever (not shown) for stressing the rod 101; a partly shown striking lever 104; a stressing tube 105 adapted to be secured non-movingly to the loom by means of a flange 106; a casing 107 and cover 108 in which a torsion rod receiver 109 (shown diagrammatically) is rotatably mounted; and an adjusting lever 110 secured to the torsion rod 101 about the longitudinal axis relative to a zero position of the rod. In addition, a slide block 111 is mounted in the lever 110. Two arrows 98, 99 in FIG. 1 indicate the direction in which the projectile (not shown) is shot off (picked)

Also visible in FIG. 1 are components of an adjusting mechanism for varying the zero position of rod 101 by way of the adjusting lever 110. This mechanism includes an adjusting motor 1, for example, a stepping motor, connected by way of a connecting cable 2 to a logic circuit arrangement (not shown) for torsion rod control; a screwthreaded spindle 2 on which a slide 4 is guided; and a wedge-shaped rigid intermediate member 10 formed with a groove 11 in which the slide 4 engages and thus converts rotation of the spindle 4 into a linear movement of the intermediate member 10.

A variety of construction equivalents to the adjusting mechanism shown in simplified form in FIG. 1 exist. For example, the slide 4 can, as shown in simplified form in FIG. la, be longer than the width of the groove 11. Instead of being guided vertically—i.e., directly towards the rod 101—the intermediate member 10 can be moved directly—i.e., not by way of the slide 4—by the spindle 3 of the motor 1. A transmission can also be provided instead of the slide 4.

Referring to FIG. 2, a "wedge casing" 120 is provided for receiving the wedge-shaped intermediate member 10 and the adjusting lever 110. One wedge flank (surface) 10*a* of the member 10 engages a stationary sliding surface 121*a* on the inside of casing wall 121. The other wedge flank (surface) 10*b* contacts the slide block 111 by way of a sliding surface 111*b* thereof By way of a second sliding surface 111*a*, the slide block 111 is rotatably mounted in the adjusting lever 110.

Movement of the intermediate member 10 in the direction indicated by the arrow 17, produced by an adjusting drive (not shown), produces a pivoting movement of the lever 110, the latter movement altering the zero position. The intermediate member 10 also transfers a force exerted by the lever 110 to the extended sliding surface 121*a*. This is advantageous since the effect is that forces and abrupt movements emanating from the rod 101 act little, if at all, on the drive 1 and are received or absorbed by the casing 120 without damage.

The force exerted by the lever 110 on the member 10 has a component parallel to the sliding surface 121*a*. This component, which depends upon the angle between the two wedge flanks (surfaces) 10*a* and 10*b*, should be so small, for example, that the friction occurring on the sliding surface 121*a* can prevent displacement of the member 10 The force component can also be received to some extent by the drive 1. Similarly, the gravitational force of the member 10 can be received by the drive 1.

Advantageously, the member 10 is moved by the motor 1 when the torsion rod 101 is in the detressed state—i.e., immediately after shoot-off (picking). The motor 1 then has to perform work only against friction and the weight of the member 10. The double arrow 17 in FIG. 2 indicates the possible travel of the member 10. This travel corresponds to an approximately 10° angular variation of the zero position of the rod 101.

The strike stress associated with shooting of the projectile causes the lever 110 to be subjected to forces causing disengagement from the flank 10*b*. A guide member 12 connected to the member 10 can obviate such disengagement. As shown in FIG. 2, a guide surface 12*a* of the guide member 12 contacts the back of the lever 110 and thus compels the same to remain on the flank 10*b*.

One possibility of ensuring that the rod 101 is not overloaded by being turned too far is for the position of the member 10 to be monitored by sensors. For example, a report of the position of the member 10 to the logic circuit arrangement of the torsion rod control can be produced by means of two inductive sensors 15*a*, 15*b* visible in FIG. 2. Overload protection for the rod 101 can be provided directly by a strain gauge 150 with connections 151 to a measuring circuit (not shown), disposed on the torsion rod 101 (see FIG. 1).

The torsion rod 101 is usually in a stressed state after a loom stoppage. In order that the zero position of the rod 101 may be varied while the loom is stationary, the rod 101 must first be detressed. Advantageously, therefore, there is a releasable connection (not shown) between the casing 120 (FIG. 2) and the stressing tube 105 (FIG. 1), so that by releasing this connection, the casing 120 can be pivoted in the direction indicated by an arrow 18 and thus distress the rod 101.

The second embodiment of the intermediate member is shown in FIG. 3 and takes the form of a pin 20 comprising a part with a screwthread 21 and a part 22 formed with splining 23.

The pin 20 is rotatably mounted on an axis perpendicular to the lever 110. In addition, the drive includes a stationary screwthreaded surface 121*a* within a sleeve 121'. This screwthreaded surface 121*a* receives the screwthread 21 of the pin 20 in order to effect movement of the pin 20 along the pin axis in response to rotation of the pin.

The drive also includes a motor 1 for rotating the pin via two meshing gears (FIG. 3*a*). In addition, the gear 6 is provided with internal teeth so as to engage in meshing relation with the splining 23 on the pin 20. As indicated in FIG. 3, the axis of the pin 20 is perpendicular to the sliding surface 111*b* of the slide block 111 mounted in the lever 110. Further, the end of the pin 20 is provided with a flat sliding surface 20*b* for engaging with the flat sliding surface 111*b* of the slide block 111. In addition, the screwthread 21 on the pin 20 has flanks 20*a* for sliding on the screwthread 121*a* in the sleeve 121' affixed to the casing wall 121.

Referring to FIG. 4, Wherein like reference characters indicate like parts as above, the intermediate member may be in the form of a disc 30 which is rotatably mounted on an axis parallel to the longitudinal axis (not shown) of the torsion rod, i.e. the pivot axis of the lever 110. As indicated, the disc 30 is provided with a spiral part 31 and a driving in part 32 having a toothed ring 33. The spiral part 31 presents a curvilinear surface of non-circular shape, e.g. a spiral surface for contacting the slide block 111 mounted in the lever 110 for pivoting of the lever 110 in response to rotation of the disc 30.

The disc 30 is also rotatably mounted on a pin 121'' which, in turn, is secured to the casing (not shown). This pin 121'' has a sliding surface 121*a* as indicated in the zone mark IA chain-dotted arc.

As illustrated, the disc has a sliding surface 30*a* facing the pin 121 "double prime" which is circular while having an outer surface 30*b* which is of spiral shape. Since the surface 30*b* is of non-constant curvature, the associated sliding surface of the slide block 111 may, with advantage, be wavy.

The zero position of the torsion rod should be adjusted with the rod in the detressed state. The adjustment is, with advantage, executed while the loom is operating. The zero adjustment can be performed in steps by means of control signals, an adjusting step occurring directly after each projectile pick-off subject to the torsion rod being stressed little, if at all.

Before a planned prolonged interruption of loom operation, for example, before a weekend, the zero adjustment control should, conveniently, be so acted on that, during a period covering a number of weaving cycles preceding the interruption, the stressing of the torsion rod increases. This adjustment of the zero point must proceed to such an extent that at a subsequent cold start, the speed of projectile flight is already sufficient at the first pick. The fact that energy conversion in the picking mechanism improves as operation continues, enables the zero position of the torsion rod to be returned to a normal position in steps by the control.

The invention thus provides a picking mechanism with a simplified adjusting mechanism which obviates or, at least, attenuates abrupt stressing of the adjusting mechanism during picking.

During operation, the forces and strikes emanating from the torsion rod affect the adjusting mechanism little, if at all, but are received or absorbed by the casing without causing damage. Further, the picking mechanism enables the zero position of the torsion rod to be adjusted in operation.

Further, before a planned interruption of operation, the zero position can be varied so that at a subsequent cold start, the torsion rode is over-stressed so that initial impairment of the lubrication of the picking mechanism is compensated for.

What is claimed is:

1. A picking mechanism for a projectile loom comprising a torsion rod having a longitudinal axis;

an adjusting lever secured to said rod for rotating said rod about said axis relative to a zero position of said rod; and an adjusting mechanism for pivoting said lever about said axis to vary said zero position of said rod, said mechanism including a rigid intermediate member disposed between said adjusting lever and a stationary surface and a drive for moving said member relative to said lever to effect a corresponding pivotal movement of said adjusting lever while transferring a force from said lever onto said stationary surface.

2. A picking mechanism as set forth in claim 1 wherein said intermediate member has a first sliding surface facing and slidably receiving said lever and a second sliding surface facing and slidably engaging said stationary surface.

3. A picking mechanism as set forth in claim 2 wherein said intermediate member is wedge-shaped and said drive moves said member in translation.

4. A picking mechanism as set forth in claim 3 which further comprises a guide member connected to said wedge-shaped intermediate member for guiding said lever therebetween to prevent disengagement of said lever from said intermediate member.

5. A picking mechanism as set forth in claim 1 which further comprises a slide block rotatably mounted in said lever and slidably contacting said intermediate member to transfer said force therebetween.

6. A picking mechanism as set forth claim 1 wherein said intermediate member is rotatably mounted on a second axis perpendicular to said lever and has a screwthread thereon and said drive includes a stationary screwthreaded surface receiving said screwthread of said intermediate member to effect movement of said member along said second axis in response to rotation of said member.

7. A picking mechanism as set forth in claim 6 wherein said drive includes a motor for rotating said intermediate member about said second axis.

8. A picking mechanism as set forth in claim 1 wherein said intermediate member is rotatably mounted on a second axis parallel to said longitudinal axis of said rod and has a curvilinear surface of non-circular shape contacting said lever for pivoting said lever in response to rotation of said member.

9. A picking mechanism as set forth in claim 8 wherein said curvilinear surface is a spiral surface.

10. A picking mechanism as set forth in claim 1 wherein said drive includes a stepping motor.

11. A picking mechanism as set forth in claim 1 which further comprises at least a pair of sensors for monitoring the position of said lever and emitting a responsive signal for activating said drive to pivot said lever.

12. A picking mechanism as set forth in claim 1 which further comprises a strain gauge on said torsion rod for monitoring the stressing thereof.

13. A picking mechanism as set forth in claim 1 which further comprises a casing having said intermediate member and said lever housed therein said casing having a wall defining said stationary surface.

14. A method of operating a picking mechanism in a projectile loom, said method comprising the steps of turning a torsion rod connected with a picking lever about a longitudinal axis thereof from a zero position to affect picking of a projectile; and adjusting said zero position of the rod stepwise directly after each picking of a projectile wherein the zero position to increase stressing of the rod is adjusted immediately before a planned interruption of operation.

* * * * *

UNITED STATES PATENT AND TRADEMARK OFFICE

CERTIFICATE OF CORRECTION

PATENT NO. : 5,186,216

DATED : February 16, 1993

INVENTOR(S) : Bollier

It is certified that error appears in the above-identified patent and that said Letters Patent is hereby corrected as shown below:

On the title page, item [57]:

Abstract, line 9, change "on to" to --onto--;

Column 3, line 10, change "thereof" to --thereof.--;

Column 4, line 24, change "Wherein" to --wherein --;

Column 5, line 10, change "rode" to --rod--;

Column 6, line 33, change " therein" to --therein,--.

Signed and Sealed this

Seventh Day of June, 1994

*Attest:*

*Attesting Officer*

BRUCE LEHMAN

*Commissioner of Patents and Trademarks*